US009799273B2

(12) United States Patent
Yang

(10) Patent No.: US 9,799,273 B2
(45) Date of Patent: Oct. 24, 2017

(54) DISPLAY DEVICE AND ONE BODY TYPE OF DRIVING DEVICE FOR DISPLAY DEVICE

(71) Applicant: SAMSUNG DISPLAY CO., LTD., Yongin, Gyeonggi-Do (KR)

(72) Inventor: Seo Hyeong Yang, Incheon (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 173 days.

(21) Appl. No.: 14/461,600

(22) Filed: Aug. 18, 2014

(65) Prior Publication Data

US 2015/0091884 A1 Apr. 2, 2015

(30) Foreign Application Priority Data

Sep. 27, 2013 (KR) ..... 10-2013-0115346

(51) Int. Cl.
*G09G 3/30* (2006.01)
*G09G 3/3283* (2016.01)
*G09G 3/3233* (2016.01)

(52) U.S. Cl.
CPC ..... *G09G 3/3283* (2013.01); *G09G 3/3233* (2013.01); *G09G 2300/0408* (2013.01); *G09G 2300/0861* (2013.01); *G09G 2320/0233* (2013.01); *G09G 2320/0295* (2013.01); *G09G 2320/043* (2013.01)

(58) Field of Classification Search
CPC ..... G09G 3/30; G09G 3/3216; G09G 3/3225; G09G 3/3233; G09G 2310/0264; G09G 2310/027; G09G 2310/0275; G09G 3/3241; G09G 3/325; G09G 3/3258; G09G 3/3266; G09G 3/3275; G09G 3/3283; G09G 3/3291; G09G 2300/0861; G09G 2300/0421; G09G 2300/0408; G09G 2300/0426; G09G 2310/0278; G09G 2320/00; G09G 2320/02; G09G 2300/0233; G09G 2320/0242; G09G 2320/029; G09G 2320/0295; G09G 2320/043; G09G 2300/043
See application file for complete search history.

(56) References Cited

U.S. PATENT DOCUMENTS

2006/0001622 A1* 1/2006 Kim ..... G09G 3/3266 345/76
2008/0265785 A1* 10/2008 Kim ..... G09G 3/3225 315/169.3
2011/0089576 A1 4/2011 Choi et al.
2013/0100173 A1* 4/2013 Chaji ..... G09G 5/10 345/690

FOREIGN PATENT DOCUMENTS

KR 10-2011-0024099 A 3/2011
KR 10-1084236 B1 11/2011

* cited by examiner

*Primary Examiner* — Lun-Yi Lao
*Assistant Examiner* — Jarurat Suteerawongsa
(74) *Attorney, Agent, or Firm* — Lee & Morse, P.C.

(57) ABSTRACT

A display device includes a data driver and a pixel current measuring unit. The data driver applies data signals to a plurality of data lines connected to a plurality of pixels. The pixel current measuring unit measures current flowing to the data lines in order to sense a state of degradation of the pixels. The data driver and pixel current measuring unit are integrally formed in one-body-type connected to the data lines.

18 Claims, 4 Drawing Sheets

DISPLAY DEVICE AND ONE BODY TYPE OF DRIVING DEVICE FOR DISPLAY DEVICE

CROSS-REFERENCE TO RELATED APPLICATION

Korean Patent Application No. 10-2013-0115346, filed on Sep. 27, 2013, and entitled, "Display Device and One Body Type of Driving Device for Display Device," is incorporated by reference herein in its entirety.

BACKGROUND

1. Field

One or more embodiments described herein relate to a display device and a one body type of driving device for a display device.

2. Description of the Related Art

A organic light emitting display generates light from organic light emitting diodes (OLEDs) to form an image. An OLED emits light using an anode layer and a cathode layer which form an electric field. An organic light emitting material in the OLED emits light based on the electric field. The luminance of the light is controlled by a current or voltage.

Displays of this type may be classified as passive matrix OLEDs (PMOLEDs) or active matrix OLEDs (AMOLEDs) based on the driving method used. An active matrix OLED selects every unit pixel to turn on light. This type of display has gained interest from the viewpoint of resolution, contrast, and speed.

The performance of an OLED tends to degrade over time. This degradation causes different amounts of light to be emitted for a given pixel current. As a result, display quality may deteriorate.

SUMMARY

In accordance with one embodiment, a display device includes a plurality of pixels; a data driver to apply data signals to a plurality of data lines, the data lines connected to the pixels; and a pixel current measuring unit connected to the data lines, wherein the pixel current measuring unit is to measure current flowing to the data lines in order to sense degradation of the pixels, and wherein the data driver and pixel current measuring unit are integrally formed in one-body-type connected to the data lines.

The data driver may include an output circuit unit to output the data signals; a plurality of underlying metal wires connected to the output circuit unit and disposed on the output circuit unit; an insulating layer on the underlying metal wires; and a plurality of overlying metal wires on the insulating layer, wherein the overlying metal wires are connected to a plurality of pads and wherein the pads are respectively connected to the data lines. The overlying metal wires may overlap the underlying metal wires.

The display device may include a contact hole located at a position where at least one overlying metal wire overlaps at least one underlying metal wire, and the at least one overlying metal wire and at least one underlying metal wire may be connected through the contact hole.

The pixel current measuring unit may include a current sensing circuit unit to sense the degradation of the pixels based on the current flowing to the data lines; and a multiplexer (MUX) unit connected to the overlying metal wires, the MUX unit to selectively connect the overlying metal wires to the current sensing circuit unit.

The current sensing circuit unit may accumulate current flowing to the data lines which are connected to the overlying metal wires through the MUX unit, convert accumulated charge into voltages, and output values of 0 or 1 after comparing the converted accumulated voltages with a reference voltage.

The pixel current measuring unit may include a channel digital-to-analog conversion (DAC) unit to convert a digital trimming value corresponding to the reference voltage into an analog reference voltage.

In accordance with another embodiment, a one-body-type driving device for a display device includes a plurality of pads connected to a plurality of data lines; a plurality of overlying metal wires connected to the pads; a plurality of underlying metal wires overlapping and connected to the overlying metal wires; an output circuit unit connected to the underlying metal wires, the output circuit unit to output data signals; a multiplexer (MUX) unit connected to the overlying metal wirings; and a current sensing circuit unit to measure current flowing to the data lines through overlying metal wires connected through the MUX unit.

The driving device may include an insulating layer between the overlying metal wires and underlying metal wires, wherein the overlying metal wires and underlying metal wires are separated by the insulating layer. A contact hole may be formed at a position where at least one of overlying metal wires overlap at least one of the underlying metal wires, and the at least one overlying metal wire and the at least one underlying metal wire may be connected through the contact hole.

The MUX unit may selectively connect the overlying metal wires to the current sensing circuit unit. The current sensing circuit unit may accumulate current flowing to the data lines which are connected to the overlying metal wires connected through the MUX unit, convert accumulated charge to voltages, and output values of 0 or 1 after comparing the converted accumulated voltages with a reference voltage.

The driving device may include a channel digital-to-analog conversion (DAC) unit to convert a digital trimming value corresponding to the reference voltage into an analog reference voltage.

In accordance with another embodiment, an integrated driver includes a data driver to apply data signals to data lines connected to a plurality of pixels; a measuring unit to measure current flowing to the data lines and to generate information indicative of a state of degradation of the pixels based on the measured current, wherein the data driver and measuring unit are integrally formed in one-body-type connected to the data lines.

The data driver may include an output circuit to output the data signals; a plurality of underlying metal wires connected to the output circuit; an insulating layer on the underlying metal wires; and a plurality of overlying metal wires on the insulating layer, wherein the overlying metal wires are connected to the data lines through a plurality of pads. A contact hole may be located at a position where at least one overlying metal wire overlaps at least one underlying metal wire, and the at least one overlying metal wire and at least one underlying metal wire may be connected through the contact hole.

The measuring unit may include a current sensing circuit to sense the measured current flowing to the data lines; and a multiplexer (MUX) to selectively connect the overlying metal wires to the current sensing circuit unit.

The current sensing circuit may accumulate current flowing to the data lines, which are connected to the overlying metal wires through the MUX unit. The current sensing circuit may convert accumulated charge into voltages and output the information indicative of the state of degradation of the pixels based on a comparison of the converted accumulated voltages with a reference voltage.

The measuring unit may include a channel digital-to-analog conversion (DAC) unit to convert a digital trimming value corresponding to the reference value to an analog reference voltage. The information indicative of the state of degradation may include a first logical value corresponding to degradation above a predetermined degree and a second logical value corresponding to degradation below the predetermined degree.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Figure 1:
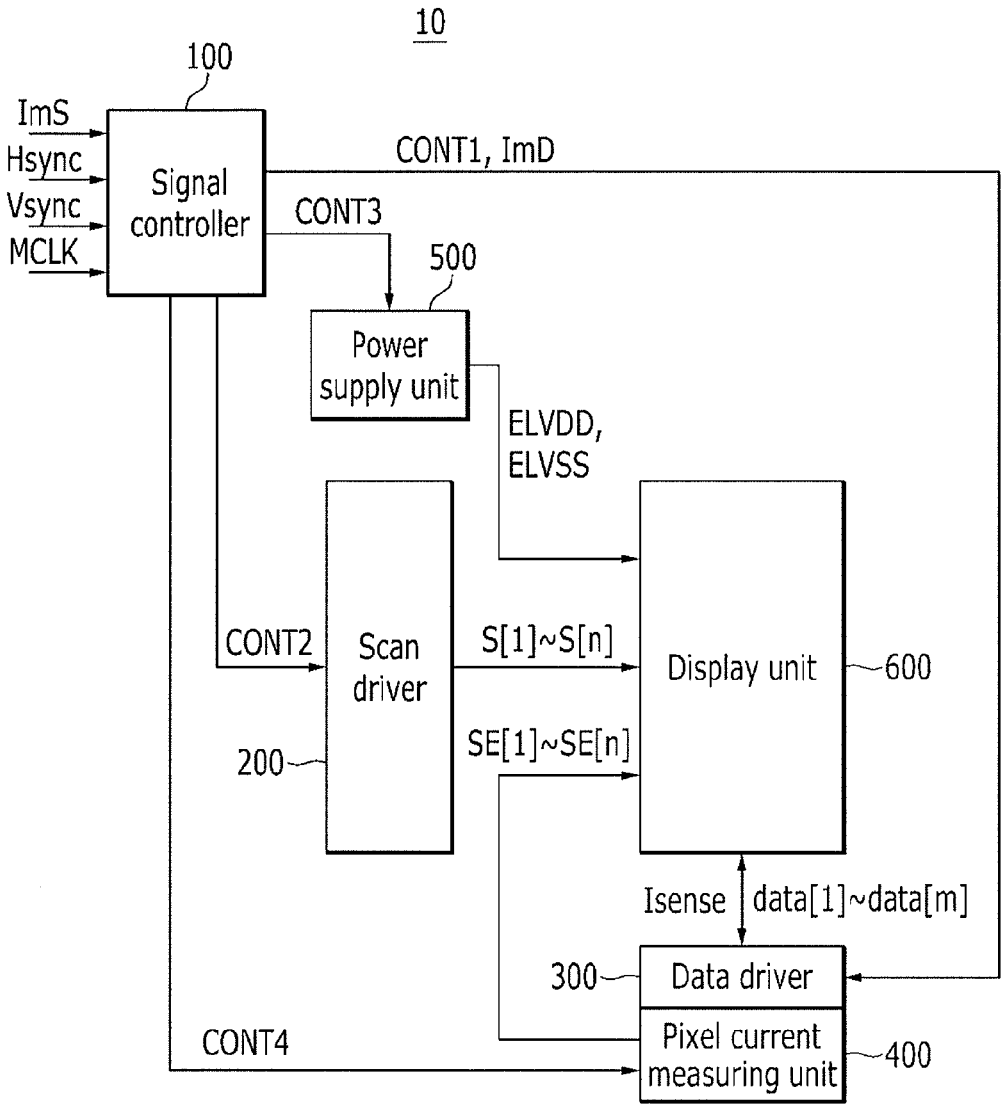
FIG. 1 illustrates an embodiment of a display device.

FIG. 1 illustrates an embodiment of a display device 10 which includes a signal controller 100, scan driver 200, data driver 300, pixel current measuring unit 400, power source supply unit 500, and display unit 600.

The signal controller 100 receives an image signal ImS and one or more synchronization signals from an external device. The input image signal ImS includes luminance information of a plurality of pixels. The luminance may be measured in terms of a predetermined number of gray scale values, e.g., $1024=2^{10}$, $256=2^{8}$, or $64=2^{6}$. The one or more synchronization signals includes a horizontal synchronization signal Hsync, a vertical synchronization signal Vsync, and/or a main clock signal MCLK.

The signal controller 100 generates first to fourth driving control signals CONT1 to CONT4 and an image data signal ImD based on video signal ImS, horizontal synchronization signal Hsync, vertical synchronization signal Vsync, and main clock signal MCLK. The signal controller 100 divides the video signal ImS into a frame unit according to the vertical synchronization signal Vsync, divides the video signal ImS into a scan line unit according to the horizontal synchronization signal Hsync, and generates image data signal ImD. The signal controller 100 transmits the image data signal ImD with the first driving control signal CONT1 to data driver 300.

The display unit 600 includes a plurality of pixels. A plurality of scan lines extend in approximately a row direction to be almost parallel to each other. A plurality of data lines extend in approximately a column direction to be almost parallel to each other. A plurality of sensing lines and a plurality of power source lines extend in approximately a row direction to be almost parallel to each other. These lines are connected to the pixels. The pixels are arranged in substantially a matrix format.

The scan driver 200 is connected to the scan lines and generates scan signals S[1] to S[n] according to the second driving control signal CONT2. The scan driver 200 may sequentially apply scan signals S[1] to S[n] of a gate-on voltage to respective ones of the scan lines.

The data driver 300 is connected to the data lines, samples and holds image data signal ImD input based on the first driving control signal CONT1, and transmits a plurality of data signals data[1]-data[m] to respective ones of the data lines. The data driver 300 may apply data signals data[1]-data[m] in a predetermined voltage range to the data lines based on the gate-on voltage of scan signals S[1] to S[n].

The pixel current measuring unit 400 is connected to a plurality of sensing lines, and generates a plurality of sensing signals SE[1]-SE[n] according to the fourth driving control signal CONT4. The pixel current measuring unit 400 may sequentially apply sensing signals SE[1]-SE[n] of the gate-on voltage. The pixel current measuring unit 400 is connected to a plurality of data lines, and measures a measuring current Isense of the data lines, to thereby sense degradation of the pixels. The measuring current Isense includes a pixel current. The pixel current measuring unit 400 may transmit information indicative of a degradation existence or degradation degree of one or more pixels to signal controller 100. Signal controller 100 may compensate image data ImD based on the degradation existence or degradation degree information.

The pixel current measuring unit 400 may be integrally formed with the data driver 300. When data driver 300 is connected to one end of a plurality of data lines, pixel current measuring unit 400 may also be connected to one end of the data lines.

The power source supply unit 500 determines levels of the first power source voltage ELVDD and second power source voltage ELVSS according to the third driving control signal CONT3. The power source supply unit 500 supplies the first and second power source voltages to power source lines connected to the pixels. The first power source voltage ELVDD and second power source voltage ELVSS provide the driving current of the pixel.

Each driving device 100, 200, 300, 400, and 500 may be directly mounted on display unit 600 in the form of at least one integrated circuit chip, mounted on a flexible printed circuit film, attached to display unit 600 in the form of a tape carrier package (TCP), or mounted on a separate printed circuit board (PCB). Alternatively, the driving devices may be integrated in display unit 600.

Figure 2:
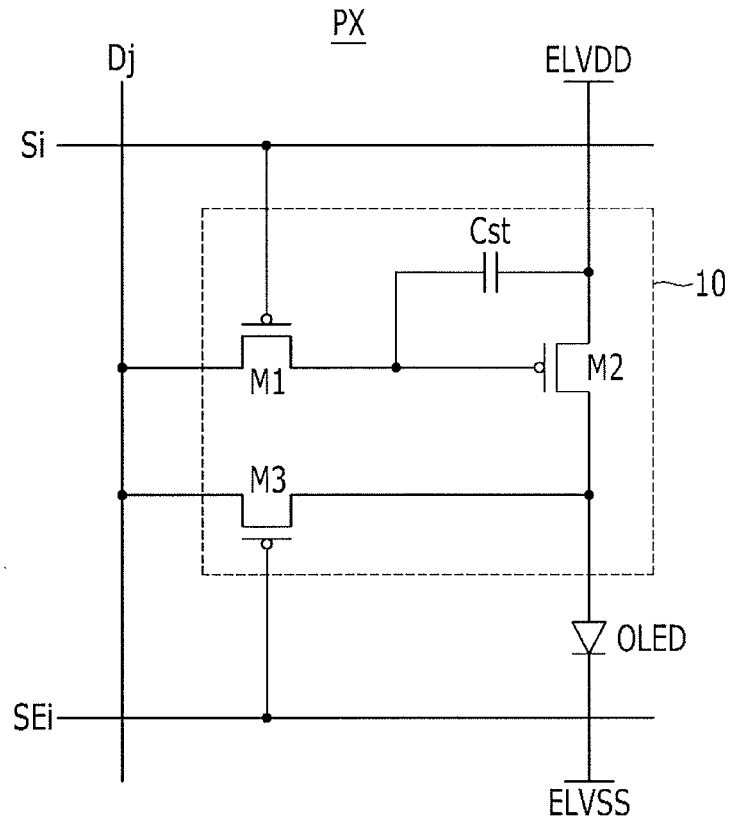
FIG. 2 illustrates an embodiment of a pixel.

FIG. 2 illustrates an embodiment of a pixel PX, which, for example, may correspond to the pixels in display nit 600. In FIG. 2, pixel PX is illustrated as a pixel positioned at an i-th row and a j-th column in display device 10, where ($1 \le I \le n$, $1 \le j \le m$).

Pixel PX includes a pixel circuit 10 to control an OLED. The pixel circuit 10 includes a switching transistor M1, a driving transistor M2, a sensing transistor M3, and a storage capacitor Cst.

The switching transistor M1 includes a gate electrode connected to scan line Si, a first terminal connected to the data line Dj, and a second terminal connected to a gate electrode of the driving transistor M2.

The driving transistor M2 has a gate electrode connected to other terminal of switching transistor M1, a first terminal connected to ELVDD voltage, and a second terminal connected to an anode of the OLED.

The sensing transistor M3 has a gate electrode connected to sensing line SEi, a first terminal connected to the other terminal of driving transistor M2, and a second terminal connected to the data line Dj.

The storage capacitor Cst has a first terminal connected to the gate electrode of driving transistor M2 and a second terminal connected to the first power source voltage ELVDD. The storage capacitor Cst charges the data voltage applied to the gate electrode of the driving transistor M2 and maintains the data voltage after the switching transistor M1 turns off.

The OLED has its anode connected to the other terminal of driving transistor M2 and a cathode connected to an ELVSS voltage. The OLED includes an organic emission layer that emits light corresponding to one of a number of primary colors. The primary colors include, for example, three primary colors of red, green, and blue. A desired color is displayed as a spatial or temporal sum of the primary colors.

The organic emission layer may be formed of a low polymer organic material or a high polymer organic material such as poly(3,4-ethylenedioxythiophene) (PEDOT). Further, the organic emission layer may be formed of multilayers including a light emitting layer and one or more of a hole injection layer (HIL), a hole transporting layer (HTL), an electron transporting layer (ETL), or an electron injection layer (EIL). In the case where all the layers are included, the hole injection layer maybe disposed on the pixel electrode 191 that is the anode, and the hole transporting layer, the light emitting layer, electron transporting layer, and electron injection layer may be sequentially laminated thereon.

The organic emission layer may include a red organic emission layer to emit red light, a green organic emission layer to emit green light, and a blue organic emission layer to emit blue light. The red organic emission layer, green organic emission layer, and blue organic emission layer are formed at a red pixel, a green pixel, and a blue pixel, respectively, to embody a color image.

Further, the organic emission layer may stack the red organic emission layer, green organic emission layer, and blue organic emission layer at the red pixel, green pixel, and blue pixel. A red color filter, green color filter, and blue color filter may be on a pixel basis, thereby embodying a color image.

In another example, a white organic emission layer to emit white light may be included at the red pixel, green pixel, and blue pixel with corresponding red, green, and blue color filters on a pixel basis. When a color image is embodied using white organic emission layers and color filters, a deposition mask for depositing a red organic emission layer, green organic emission layer, and blue organic emission layer at respective individual pixels (i.e., red pixel, green pixel, and blue pixel) is not necessary.

According to another example, a white organic emission layer may be formed in one organic emission layer, and may include a configuration that emits white light by stacking a plurality of organic emission layers. For example, the white organic emission layer may include a configuration that emits white light by combining at least one yellow organic emission layer and at least one blue organic emission layer, a configuration that emits white light by combining at least one cyan organic emission layer and at least one red organic emission layer, and/or a configuration that emits white light by combining at least one magenta organic emission layer and at least one green organic emission layer.

The switching transistor M1, the driving transistor M2, and the sensing transistor M3 may be p-channel field effect transistors. In this case, the gate-on voltage that turns on the switching transistor M1, the driving transistor M2, and the sensing transistor M3 may be a low level voltage. The gate-off voltage that turns them off is a high level voltage.

In an alternative embodiment, at least one of the switching transistor M1, the driving transistor M2, and the sensing transistor M3 may be an n-channel field effect transistor. In this case, the gate-on voltage that turns on the n-channel field effect transistor is a high level voltage and the gate off voltage that turns this transistor off is a low level voltage.

When the scanning signal S[i] of the gate-on voltage is applied to the scan line Si, the switching transistor M1 turns on. When the switching transistor M1 turns on, the data signal applied to the data line Dj is applied to one terminal of the storage capacitor Cst through the transistor M1, to thereby charge the storage capacitor Cst. The driving transistor M2 controls pixel current flowing from the first power source voltage ELVDD to the OLED based on the voltage charged to the storage capacitor Cst. The OLED generates light based on the amount of the pixel current flowing through the driving transistor M2.

In general driving, in which the display device 10 displays an image, sensing signal SE[i] of the gate-off voltage is applied to the sensing line SEi, and the sensing transistor M3 is turned off.

In compensation driving, in which the display device 10 measures each pixel current of a plurality of pixels PX to compensate for degradation of the pixels PX, the sensing signal SE[i] of the gate-on voltage is applied to the sensing line SEi, and the sensing transistor M3 is turned on. The pixel current flows to the data line Dj through the turned-on sensing transistor M3.

The structure of pixel PX in FIG. 2 is only an exemplary embodiment. The pixel may have a different structure in other embodiments.

Figure 3:
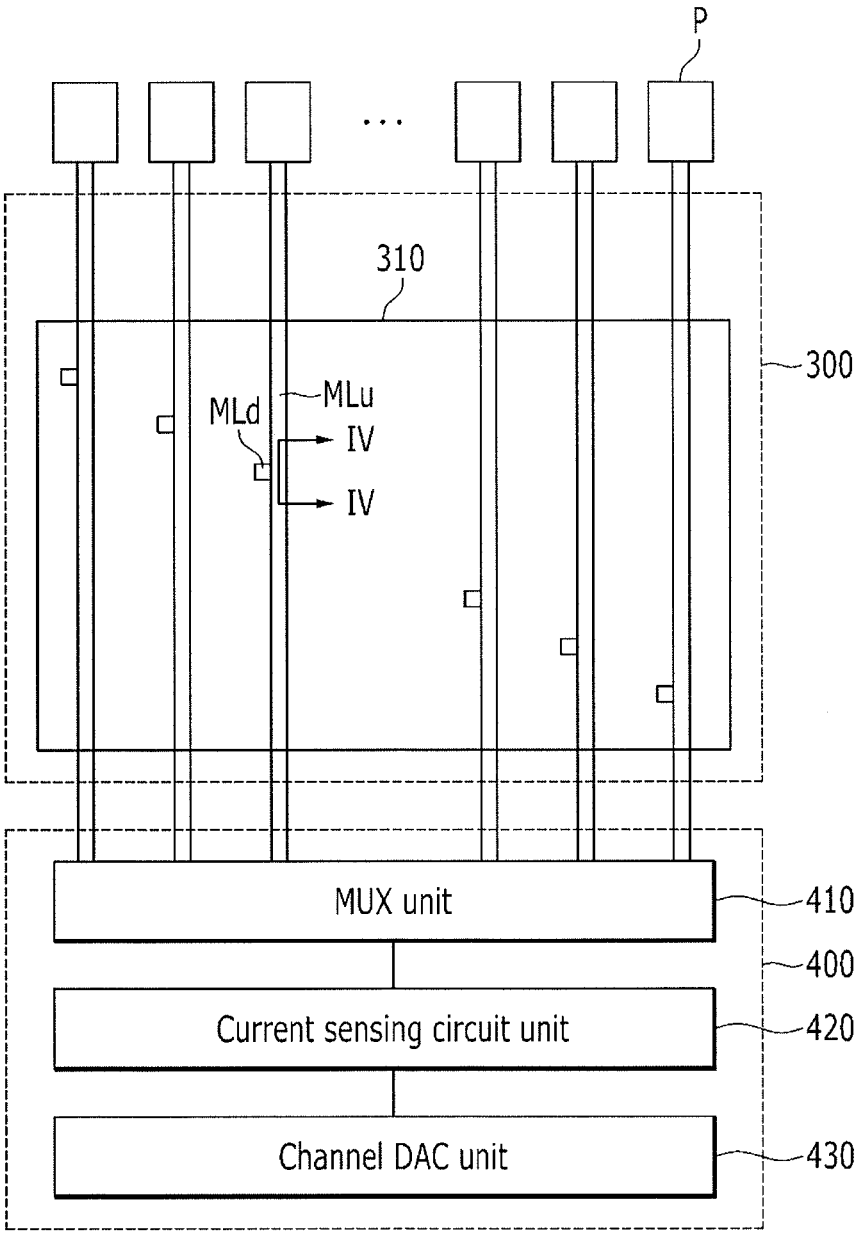
FIG. 3 illustrates a one-body-type of driving device for a display device.
Figure 4:
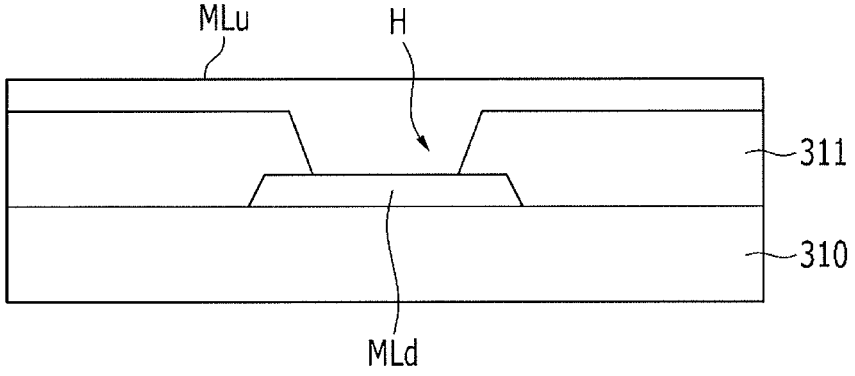
FIG. 4 illustrates an incision surface along section line IV-IV in FIG. 3.

FIGS. 3 and 4 illustrate an embodiment of the data driver 300 and the pixel current measuring unit 400. The integrated data driver 300 and the pixel current measuring unit 400 are referred to as a one-body-type of driving device for the display device. One display device 10 may include one or more one-body0type driving devices for the display device. FIG. 3 illustrates a one-body-type driving device for the display device, and FIG. 4 illustrates a cross-sectional view of an incision surface taken along line IV-IV in FIG. 3.

Referring to FIGS. 3 and 4, the one-body-type driving device for the display device includes a plurality of pads P, the data driver 300, and the pixel current measuring unit 400. The pads P are connected to respective data lines of the display device 10. The number of the pads P in the one-body-type driving device may be varied in different embodiments. For example, the number of the pads P may be 15 or 30.

The data driver 300 includes an output circuit unit 310, a plurality of underlying metal wirings MLd on the output circuit unit 310, an insulating layer 311 on the underlying metal wires MLd, and the overlying metal wires MLu on the insulating layer 311. The output circuit unit 310 includes a circuit outputting data signals data[1]-data[m] in a predetermined voltage range.

The underlying metal wires MLd are on the output circuit unit 310, and connect the output circuit unit 310 to the overlying metal wires MLu. For example, the output circuit unit 310 includes a plurality of output terminals to output data signals to the data lines. The output terminals and underlying metal wires MLd are connected to each other. The underlying metal wires MLd may be formed of copper (Cu), aluminum (Al), molybdenum (Mo), silver (Ag), or another metal or conductive material.

The insulating layer 311 is between the underlying metal wires MLd and overlying metal wires MLu, and serves to separate underlying metal wires MLd and overlying metal wires MLu. The insulating layer 311 has contact holes H to connect the underlying metal wires MLd and overlying metal wires MLu. The insulating layer 311 may be made of an inorganic insulating material such as a silicon oxide ($SiO_x$) or a silicon nitride ($SiN_x$). Alternatively, the insulating layer 311 may be made of an organic insulating material such as a cellulose derivative, an olefin-based resin, an acryl-based resin, a vinyl chloride-based resin, a styrene-based resin, a polyester-based resin, a polyamide-based resin, a polycarbonate-based resin, a polycycloolefin resin, or an epoxy resin.

The overlying metal wires MLu are connected to respective ones of the pads P, and extend in an approximately a column direction in parallel to each other. The overlying metal wires MLu may overlap underlying metal wires MLd. The contact holes H are formed at overlapping positions of the overlying metal wires MLu and underlying metal wires MLd. The overlying metal wires MLu and underlying metal wires MLd are respectively connected to each other through corresponding contact holes H. The overlying metal wires MLu may be formed of copper (Cu), aluminum (Al), molybdenum (Mo), silver (Ag), or another metal or conductive material.

The output circuit unit 310 is connected to underlying metal wires MLd, the overlying metal wires MLu (which are connected to the underlying metal wires MLd through contact holes H), and the data lines through pads P (which are connected to the overlying metal wires MLu), to thereby apply the data signals to the data lines.

The pixel current measuring unit 400 includes a multiplexer (MUX) unit 410, a current sensing circuit unit 420, and a channel digital-to-analog conversion (DAC) unit 430. The MUX unit 410 is connected to the overlying metal wires MLu. The MUX unit 410 may be connected directly to the overlying metal wires MLu or through separate underlying metal wires. The manner in which the overlying metal wires MLu are connected through the separate underlying metal wires may be the same as previously described, e.g., through contact holes H.

The MUX unit 410 selectively connects the overlying metal wires MLu to the current sensing circuit unit 420. For example, MUX unit 410 selectively connects the current sensing circuit unit 420 to the data lines.

The current sensing circuit unit 420 accumulates a measuring current Isense flowing to the data lines through the MUX unit 410, converts the accumulated charge to a voltage, and outputs a value of 0 or 1 after comparing the converted voltage with a reference voltage. In this embodiment, the value of 0 or 1 output from the current sensing circuit unit 420 is indicative of the degradation existence or degradation degree of a corresponding pixel.

The channel DAC unit 430 is connected to the current sensing circuit unit 420, and converts a digital trimming value to generate the reference voltage to an analog reference voltage. The converted analog reference voltage is provided as the reference voltage of the current sensing circuit unit 420.

As described above, the output circuit unit 310 outputs the data signal and is connected to the overlying metal wires MLu, which are connected to the data lines through the underlying metal wires MLd. The current sensing circuit unit 420 is connected to the overlying metal wires MLu through MUX unit 410. As a result, the data driver 300 and the pixel current measuring unit 400 are integrally formed. Accordingly, the manufacturing cost of the display device 10 may be reduced.

By way of summation and review, the performance of an OLED tends to degrade over time. This degradation causes different amounts of light to be emitted for a given pixel current. As a result, display quality may deteriorate.

Various methods have been developed in an attempt to compensate for OLED degradation. However, these methods require separate circuits to be used, which are connected by additional wiring. This increases complexity, the area occupied by the display driver control circuits, and manufacturing costs. This methods may also unnecessarily increase pixel current.

One or more of the aforementioned embodiments provide an integral, one-body-type display device for outputting data signals and for measuring of pixel current. Because output of the data signals and measuring of the pixel currents are integrally performed, the manufacturing cost of the display device may be reduced. Also, a reduction in the area occupied by the control circuits of the display driver circuits may be realized.

The methods and processes described herein may be performed by code or instructions to be executed by a computer, processor, or controller. Because the algorithms that form the basis of the methods are described in detail, the code or instructions for implementing the operations of the method embodiments may transform the computer, processor, or controller into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, or controller which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a plurality of pixels in a display area;

a data driver, outside of the display area, to apply data signals to a plurality of data lines, the data lines connected to the pixels;

a plurality of pads connected to the data driver; and a pixel current measuring circuit connected to an end of the data lines, wherein the pixel current measuring circuit is to measure current flowing to the data lines in order to sense degradation of the pixels, wherein the data driver and pixel current measuring circuit are integrally formed in one-body-type connected to the data lines, and wherein the data driver includes:

an output circuit, different from the pads, writ to output the data signals, a plurality of underlying metal wires directly connected to the output circuit, and a plurality of overlying metal wires connected to the data lines, and wherein the plurality of underlying metal wires and the plurality of overlying metal wires overlap the output circuit.

2. The display device as claimed in claim 1, wherein the overlying metal wires overlap the underlying metal wires.

3. The display device as claimed in claim 2, wherein:

a contact hole is located at a position where at least one overlying metal wire overlaps at least one underlying metal wire, and the at least one overlying metal wire and at least one underlying metal wire are connected through the contact hole.

4. The display device as claimed in claim 3, wherein the pixel current measuring circuit includes:

a current sensing circuit to sense the degradation of the pixels based on the current flowing to the data lines; and a multiplexer (MUX) connected to the overlying metal wires, the MUX to selectively connect the overlying metal wires to the current sensing circuit.

5. The display device as claimed in claim 4, wherein the current sensing circuit is to accumulate measuring current flowing to the data lines which are connected to the overlying metal wires through the MUX, convert accumulated charge into voltages, and output values of 0 or 1 after comparing the converted accumulated voltages with a reference voltage.

6. The display device as claimed in claim 5, wherein the pixel current measuring includes a channel digital-to-analog converter (DAC) to convert a digital trimming value corresponding to the reference voltage into an analog reference voltage.

7. A one-body-type driving device for a display device, comprising:

a plurality of pads connected to a plurality of data lines; a plurality of overlying metal wires connected to the pads;

a plurality of underlying metal wires overlapping and connected to the overlying metal wires;

an output circuit, different from the pads, directly connected to the underlying metal wires, the output circuit unit to output data signals;

a multiplexer (MUX) connected to the overlying metal wirings; and a current sensing circuit unit to measure current flowing to the data lines through overlying metal wires connected through the MUX, wherein the plurality of underlying metal wires and the plurality of overlying metal wires overlap the output circuit.

8. The driving device as claimed in claim 7, further comprising:

an insulating layer between the overlying metal wires and the underlying metal wires, wherein the overlying metal wires and underlying metal wires are separated by the insulating layer.

9. The driving device as claimed in claim 8, wherein:

a contact hole is formed at a position where at least one of overlying metal wires overlap at least one of the underlying metal wires, and the at least one overlying metal wire and the at least one underlying metal wire are connected through the contact hole.

10. The driving device as claimed in claim 7, wherein the MUX is to selectively connect the overlying metal wires to the current sensing circuit.

11. The driving device as claimed in claim 10, wherein the current sensing circuit is to accumulate current flowing to the data lines which are connected to the overlying metal wires connected through the MUX, convert accumulated charge to voltages, and output values of 0 or 1 after comparing the converted accumulated voltages with a reference voltage.

12. The driving device as claimed in claim 11, further comprising: a channel digital-to-analog conversion (DAC) to convert a digital trimming value corresponding to the reference voltage into an analog reference voltage.

13. An integrated driver, comprising:

a data driver, outside of a display area, to apply data signals to data lines connected to a plurality of pixels;

a plurality of pads connected to the data driver; and a measuring circuit connected to an end of the data lines, wherein the measuring circuit is to measure current flowing to the data lines and to generate information indicative of a state of degradation of the pixels based on the measured current, wherein the data driver and measuring circuit are integrally formed in one-body-type connected to the data lines, wherein the data driver includes:

an output circuit, different from the pads, to output the data signals; a plurality of underlying metal wires directly connected to the output circuit; and a plurality of overlying metal wires connected to the data lines, and wherein the plurality of underlying metal wires and the plurality of overlying metal wires overlap the output circuit.

14. The driver as claimed in claim 13, wherein:

a contact hole is located at a position where at least one overlying metal wire overlaps at least one underlying metal wire, and the at least one overlying metal wire and at least one underlying metal wire are connected through the contact hole.

15. The driver as claimed in claim 13, wherein the measuring circuit includes:

a current sensing circuit to sense the measured current flowing to the data lines; and a multiplexer (MUX) to selectively connect the overlying metal wires to the current sensing circuit.

16. The driver as claimed in claim 15, wherein the current sensing circuit is to accumulate current flowing to the data lines which are connected to the overlying metal wires through the MUX, convert accumulated charge into voltages, and output the information indicative of the state of degradation of the pixels based on a comparison of the converted accumulated voltages with a reference voltage.

17. The driver as claimed in claim 16, wherein the measuring circuit includes a channel digital-to-analog conversion (DAC) to convert a digital trimming value corresponding to the reference value to an analog reference voltage.

18. The driver as claimed in claim 16, wherein the information indicative of the state of degradation includes a first logical value corresponding to degradation above a predetermined degree and a second logical value corresponding to degradation below the predetermined degree.

* * * * *